US010059473B2

(12) United States Patent
Volby et al.

(10) Patent No.: US 10,059,473 B2
(45) Date of Patent: Aug. 28, 2018

(54) EJECTOR FOR SEAL FIXTURE MACHINE

(71) Applicant: BELCO PACKAGING SYSTEMS, INC., Monrovia, CA (US)

(72) Inventors: Tom Volby, Monrovia, CA (US); Sharon Mahoney, Monrovia, CA (US)

(73) Assignee: BELCO PACKAGING SYSTEMS, INC., Monrovia, CA (US)

( * ) Notice: Subject to any disclaimer, the term of this patent is extended or adjusted under 35 U.S.C. 154(b) by 437 days.

(21) Appl. No.: 14/815,911

(22) Filed: Jul. 31, 2015

(65) Prior Publication Data

US 2017/0029145 A1 Feb. 2, 2017

(51) Int. Cl.
*B65B 7/28* (2006.01)
*B65B 61/28* (2006.01)

(52) U.S. Cl.
CPC ..... *B65B 7/2878* (2013.01); *B65B 61/28* (2013.01)

(58) Field of Classification Search
CPC ..... B65B 7/2842; B65B 7/2878; B65B 57/08; B65B 61/28
USPC ..... 53/75, 76, 329.2, 329.3, 369
See application file for complete search history.

(56) References Cited

U.S. PATENT DOCUMENTS 3,316,690 A * 5/1967 Straub et al. ..... B65B 7/2878 53/329.3
3,372,081 A * 3/1968 Hurschman ..... B29C 66/53461 156/583.3
3,508,373 A * 4/1970 Robinson, Jr. ..... B65B 31/028 53/408
4,051,646 A * 10/1977 Ursic ..... B65B 7/28 53/363
4,349,093 A * 9/1982 Tsujio ..... F16D 69/0408 192/107 R
4,583,350 A * 4/1986 Artusi et al. ..... B65B 7/2878 156/69
5,272,854 A * 12/1993 Ye et al. ..... B65B 7/164 53/329.2
5,784,858 A * 7/1998 Lastovich et al. .... B65B 7/2878 53/329
5,930,977 A * 8/1999 Hsu ..... B65B 7/164 53/329.3
6,499,271 B1 * 12/2002 Lastovich et al. .... B65B 7/2878 53/329.2
6,739,109 B1 * 5/2004 Fan ..... B65B 7/2878 53/300
7,204,069 B2 * 4/2007 Liao ..... B65B 31/028 53/300
7,506,491 B2 * 3/2009 Rimondi ..... B65B 31/043 53/389.2
7,644,744 B2 * 1/2010 Fan ..... B65B 7/164 156/361

(Continued)

*Primary Examiner* — Stephen F Gerrity
(74) *Attorney, Agent, or Firm* — Lewis Roca Rothgerber Christie LLP

(57) ABSTRACT

A system for heat sealing two or more components together into at least one sealed package is disclosed. The system includes a heat press configured to heat seal the two or more components together into the at least one sealed package, a seal fixture including an upper seal fixture plate configured to support the two or more components, and an ejector plate under the upper seal fixture plate. The ejector plate is configured to move between a retracted position and a deployed position to at least partially raise the at least one sealed package off of the upper seal fixture plate.

21 Claims, 4 Drawing Sheets

(56) References Cited

U.S. PATENT DOCUMENTS

| | | | | |
|---|---|---|---|---|
| 8,646,244 | B2 * | 2/2014 | Ludwig et al. | B65B 7/2878<br>493/470 |
| 2001/0052219 | A1 * | 12/2001 | Fan | B65B 7/2878<br>53/329 |
| 2013/0318919 | A1 * | 12/2013 | Neale et al. | B65B 7/164<br>53/329.2 |

* cited by examiner

EJECTOR FOR SEAL FIXTURE MACHINE

FIELD

The present disclosure relates generally to ejector systems and, more particularly, to ejectors for heat sealing systems.

BACKGROUND

A variety of heat sealing systems exist to join two components together to form a sealed container, including direct contact thermal sealers, continuous band-type heat sealers, impulse heat sealers, non-contact heat sealers (e.g., induction heat sealers), and ultrasonic welders. In some heat sealing systems, pressure and heat are applied to a common joint between the two components. The application of heat and pressure causes the two components to fuse together along the seal joint.

Following the joining of the two components together, the sealed container is conventionally removed from a support fixture by an operator manually lifting the sealed container off of the support fixture. However, the manual removal process may damage the sealed container. For instance, if the seal joint has not completely cooled when the sealed container is handled by the operator, the manual removal of the sealed container may compromise the seal joint. Additionally, during the manual removal of the sealed container, the operator may apply non-uniform pressure to the sealed container, which may compromise the seal joint. Furthermore, the support fixture may be hot following the heat sealing process. Accordingly, the support fixture presents a risk that heat may be inadvertently transferred to the sealed container after the heat sealing process if the operator does not carefully remove the sealed container from the support fixture. Inadvertently transferring heat from the support fixture to the sealed container may create a glue "burn" or other cosmetic issues on the sealed container.

SUMMARY

The present disclosure is directed to various embodiments of a system for heat sealing two or more components together into at least one sealed package. The system includes a heat press configured to heat seal the two or more components together into the at least one sealed package, a seal fixture including an upper seal fixture plate configured to support the two or more components, and an ejector plate under the upper seal fixture plate. The ejector plate is configured to move between a retracted position and a deployed position to at least partially raise the at least one sealed package off of the upper seal fixture plate. When the at least one sealed package is supported on the seal fixture and the ejector plate is in the retracted position, the ejector plate is spaced apart from the at least one sealed package. When the at least one sealed package is supported on the seal fixture and the ejector plate is in the deployed position, the ejector plate is engaged with the at least one sealed package.

The system may include a shuttle supporting the seal fixture. The shuttle is configured to transport the seal fixture between a loading and unloading platform outside the heat press and an operating position inside the heat press. The system may include a lifting assembly under the loading and unloading platform. The lifting assembly is configured to engage the ejector plate to move the ejector plate between the retracted position and the deployed position. The lifting assembly may include a series of lift rods configured to engage a series of receptacles on the ejector plate to move the ejector plate between the retracted position and the deployed position. The system may also include an actuator assembly configured to engage the lifting assembly to cause the at least one lift rod to selectively engage and disengage the at least one receptacle of the ejector plate. The actuator assembly may include a motor and a controller configured to actuate the motor.

The system may include a shuttle motor coupled to the shuttle. The shuttle motor is configured to move the shuttle and the seal fixture between the loading position outside the heat press and the operating position inside the heat press. The shuttle may be configured to be moved manually between the loading position outside the heat press and the operating position inside the heat press. The upper seal fixture plate may define at least one opening configured to accommodate at least a portion of one component of the two or more components. The seal fixture may also include a series of locating pins arranged around the at least one opening. The ejector plate may have any suitable configuration, such as a slotted plate. The system may include a controller configured to move the ejector plate at a first speed toward the at least one sealed package supported on the seal fixture when the ejector plate is spaced apart from the at least one sealed package and to move the ejector plate at a second speed less than the first speed when the ejector plate is engaged with the at least one sealed package supported on the seal fixture.

This summary is provided to introduce a selection of concepts that are further described below in the detailed description. This summary is not intended to identify key or essential features of the claimed subject matter, nor is it intended to be used in limiting the scope of the claimed subject matter. One or more of the described features may be combined with one or more other described features to provide a workable device.

BRIEF DESCRIPTION OF THE DRAWINGS

The features and advantages of embodiments of the present disclosure will become more apparent by reference to the following detailed description when considered in conjunction with the following drawings. In the drawings, like reference numerals are used throughout the figures to reference like features and components. The figures are not necessarily drawn to scale.

DETAILED DESCRIPTION

The present disclosure is directed to various embodiments of a heat sealing system configured to seal two or more components together (e.g., a lid and a tray) to form one or more sealed packages. The sealed packages may store any desired type of device or devices, such as, for instance, one or more medical device components, that may be accessed, for instance, by an end user peeling back the lid from the tray. The present disclosure is also directed to an ejector system configured to lift at least a portion of the one or more sealed packages off of a support fixture after the heat sealing process. The ejector system according to various embodiments of the present disclosure is configured to enable an operator to completely remove the sealed packages from the support fixture without damaging the sealed packages, such as, for instance, by lifting the sealed packages after the seal joint between the two components of each sealed package has had sufficient time to cool and cure and/or by applying a uniform or generally uniform pressure to partially raise the one or more sealed packages off of the support fixture.

Figure 1A:
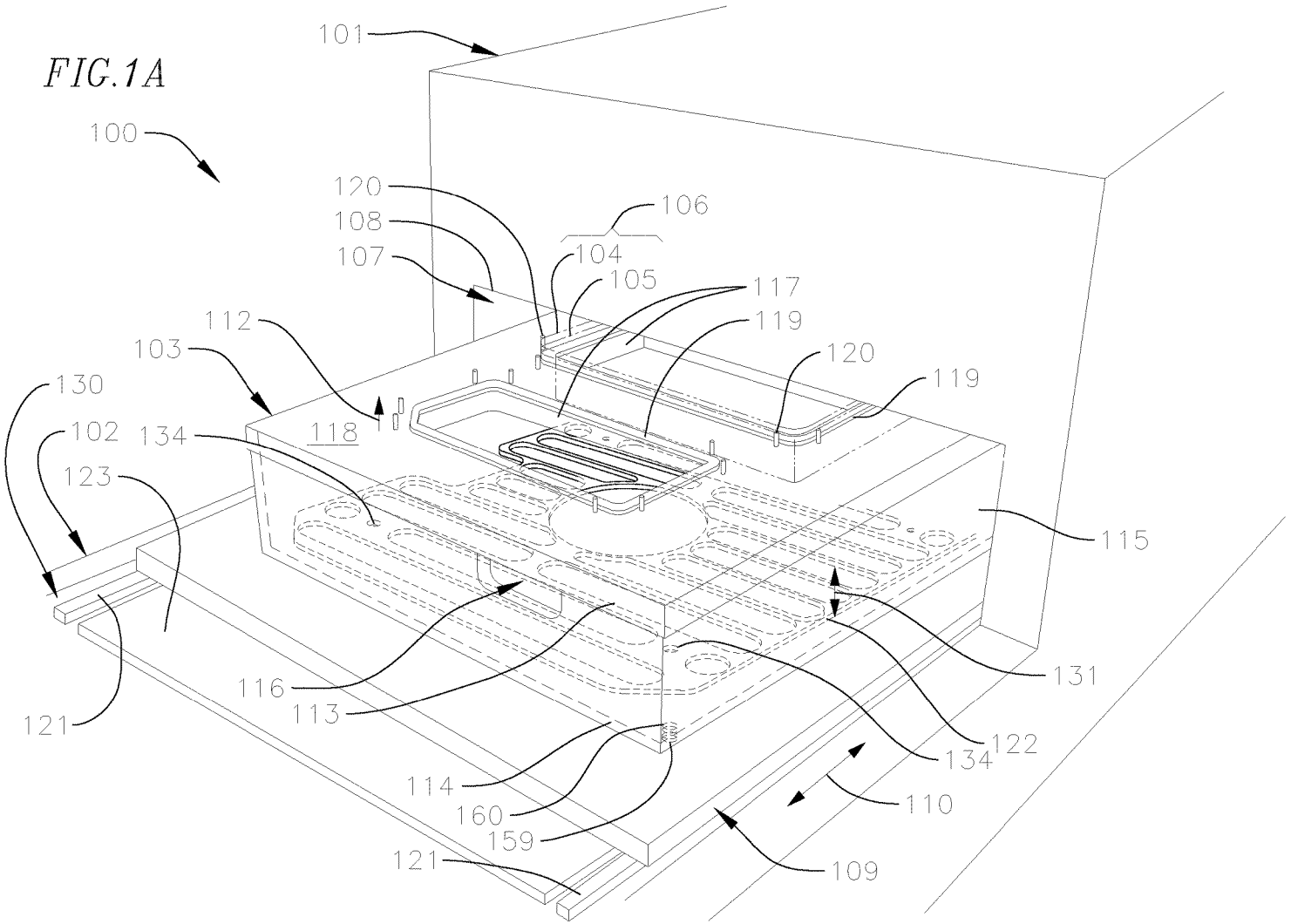
FIGS. 1A and 1B are a perspective view and a side view, respectively, of a heat sealing system including a heat press, a seal fixture, and an ejector assembly according to one embodiment of the present disclosure.
Figure 1B:
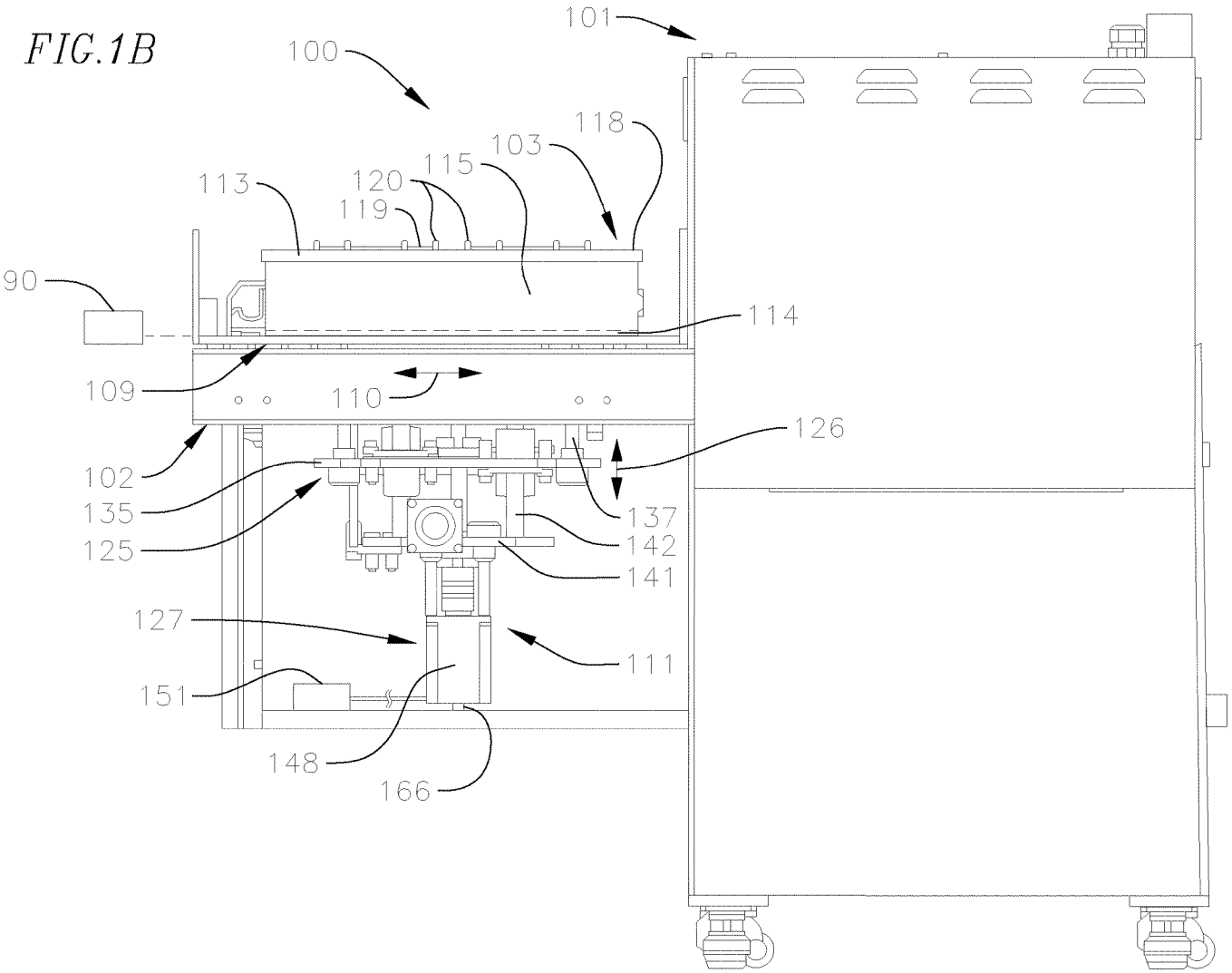

With reference now to FIGS. 1A and 1B, a heat sealing system 100 according to one embodiment of the present disclosure includes a heat press 101, a loading and unloading platform or frame 102 outside the heat press 101, and a seal fixture 103 (i.e., a support fixture) configured to support at least one upper component 104 (e.g., a lid) and at least one corresponding lower component 105 (e.g., a tray) to be sealed together into one or more sealed packages 106 by the heat press 101, as described in more detail below. The one or more sealed package 106 may store any desired type of device or devices, such as, for instance, one or more medical device components. The heat press 101 defines a sealing chamber 107 and an entrance 108 that opens up into the sealing chamber 107. The sealing chamber 107 is configured to supply an elevated temperature and pressure to join the upper and lower components 104, 105 together. In the illustrated embodiment, the heat sealing system 100 also includes a shuttle 109 configured to move (arrow 110) the seal fixture 103 and the components 104, 105 supported thereon into and out of the sealing chamber 107 of the heat press 101 through the entrance 108, and an ejector assembly 111 (see FIG. 1B) configured to at least partially raise (arrow 112) the one or more sealed packages 106 out of the seal fixture 103 following the heat sealing process by the heat press 101 (e.g., the ejector assembly 111 is configured to at least partially raise the one or more sealed packages 106 out of the seal fixture 103 after the shuttle 109 has returned the seal fixture 103 and the one or more sealed packages 106 to the loading and unloaded platform 102 following the heat sealing process in the heat press 101).

With continued reference to the embodiment illustrated in FIGS. 1A and 1B, the seal fixture 103 includes an upper seal fixture plate 113, a lower support plate 114 spaced below the upper seal fixture plate 113, and at least one sidewall 115 extending between the lower support plate 114 and the upper seal fixture plate 113. Together, the upper seal fixture plate 113, the lower support plate 114, and the at least one sidewall 115 form a box-like structure defining an interior chamber 116. Although in the illustrated embodiment the upper seal fixture plate 113 and the lower support plate 114 are square and the seal fixture 103 includes four sidewalls 115 arranged in square configuration (e.g., the seal fixture 103 has a square prismatic shape), in one or more embodiments, the upper seal fixture plate 113 and the lower support plate 114 may have any other suitable shape and the seal fixture 103 may have any other number of sidewalls 115 depending on the shape of the upper seal fixture plate 113 and the lower support plate 114.

Additionally, in the illustrated embodiment, at least one opening 117 (e.g., a through hole) is defined in the upper seal fixture plate 113. Each opening 117 defined in the upper seal fixture plate 113 is configured to receive (e.g., accommodate) one of the lower components 105 (e.g., a tray) and a corresponding one of the upper components 104 (e.g., a lid) on the lower component 105. For instance, in one or more embodiments, at least a portion of the lower component 105 is configured to extend down into the opening 117 in the upper seal fixture plate 113 and the upper component 104 is configured to be supported on the lower component 105. Additionally, in one or more embodiments, the lower component 105 may include a lip configured to overhang a portion of an upper surface 118 of the upper seal fixture plate 113. The engagement between the lip on the lower component 105 and the upper seal fixture plate 113 is configured to prevent the lower component 105 from falling down through the opening 117. Each of the openings 117 defined in the upper seal fixture plate 113 may have any shape and size depending on the shape and size of the upper and lower components 104, 105 that the seal fixture 103 is intended to support. Additionally, any suitable number of openings 117 may be defined in the upper seal fixture plate 113 depending on the number of components 104, 105 the seal fixture 103 is designed to support. Furthermore, although in one embodiment each of the openings 117 may have the same shape and size, in one or more alternate embodiments, the openings 117 defined in the seal fixture 103 may have two or more different shapes and/or different sizes.

In the illustrated embodiment, the seal fixture 103 includes a gasket 119 extending around each of the openings 117 in the upper seal fixture plate 113. In the illustrated embodiment, each of the gaskets 119 is supported on the upper surface 118 of the upper seal fixture plate 113. Each of the gaskets 119 is configured to protect the lower components 105 as the lower components 105 are inserted into the openings 117 and removed from the openings 117 in the seal fixture 103. Additionally, in the illustrated embodiment, the seal fixture 103 includes a series of locating pins 120 extending around each of the openings 117 in the upper seal fixture plate 113. The locating pins 120 extend (i.e., project) upward from the upper surface 118 of the upper seal fixture plate 113. The locating pins 120 are configured to enable an operator to properly align the one or more upper components 104 with the corresponding lower component 105 when the upper and lower components 104, 105 are loaded into the seal fixture 103. The locating pins 120 are also configured to maintain the upper and lower components 104, 105 in proper alignment during the process of heat sealing the upper and lower components 104, 105 together with the heat press 101. In one or more alternate embodiments, the seal fixture 103 may be provided without the locating pins 120.

The upper and lower components 104, 105 may be made out of any materials suitable to be bonded together by a heat sealing process, such as, for instance, a polyester film such as biaxially-oriented polyethylene terephthalate (BoPET) (e.g., mylar), paper, foil, thermoplastic, or combinations thereof. Although in one or more embodiments the upper component 104 may be the same or similar material as the lower component 105, in one or more alternate embodiments, the upper and lower components 104, 105 may be made from dissimilar materials. Additionally, in one or more embodiments, an adhesive (e.g., a thermally-activated adhesive) may be provided between the upper and lower components 104, 105.

With continued reference to the embodiment illustrated in FIGS. 1A and 1B, the seal fixture 103 is supported on the shuttle 109. In the illustrated embodiment, the shuttle 109 is configured to slide along a pair of rails or guides 121 on opposite sides of the loading and unloading platform 102 to move (arrow 110) the seal fixture 103 into and out of the sealing chamber 107 through the entrance 108 in the heat press 101. Although in one or more embodiments the shuttle 109 may be driven by a motor 90 to automatically move (arrow 110) the shuttle 109 and the seal fixture 103 into and out of the heat press 101, in one or more alternate embodiments, the shuttle 109 and the seal fixture 103 may be manually moved into and out of the heat press 101.

Figure 2A:
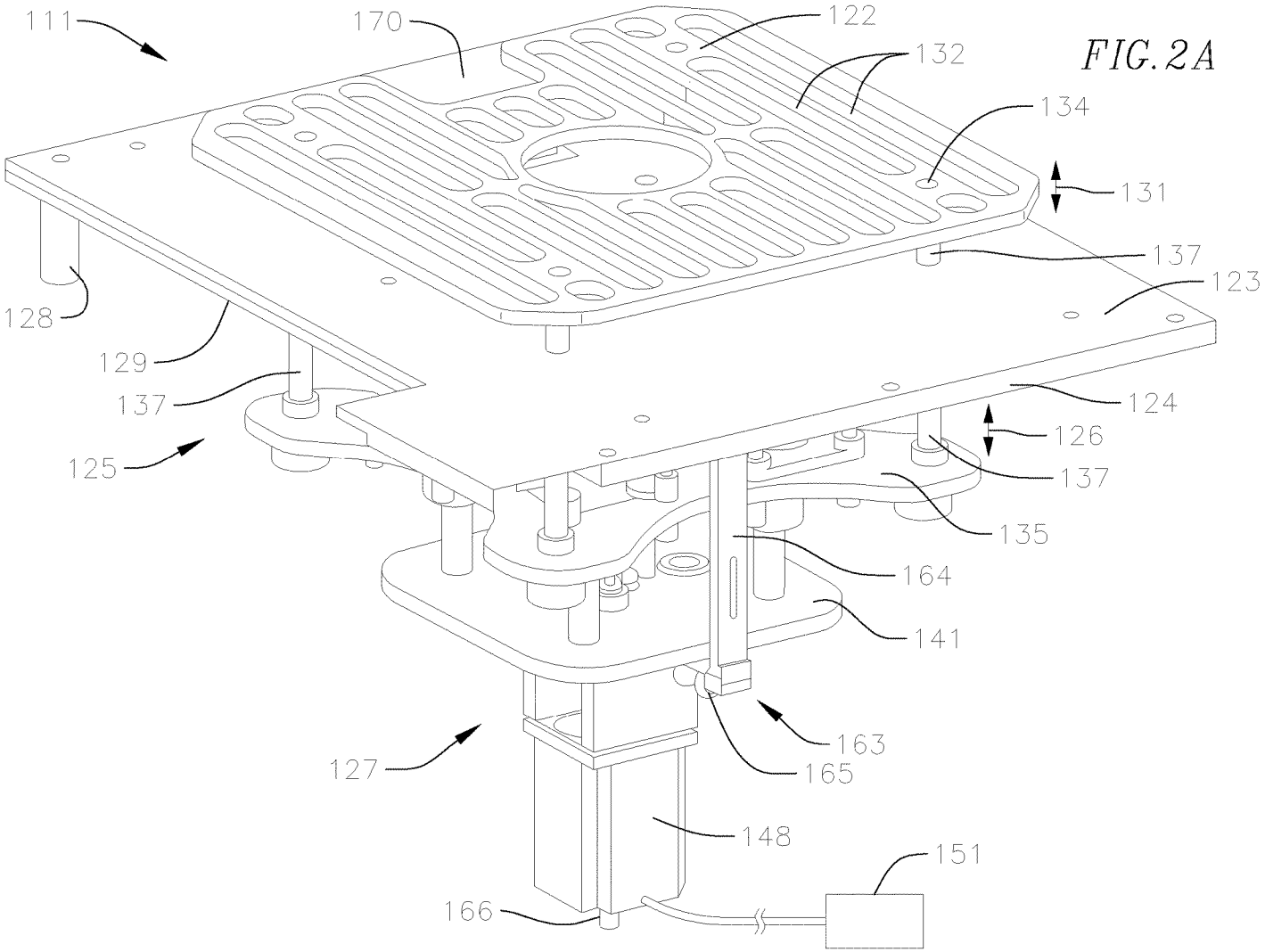
FIGS. 2A and 2B are a perspective view and an exploded perspective view, respectively, of an ejector assembly according to the embodiment illustrated in FIGS. 1A and 1B.
Figure 2B:
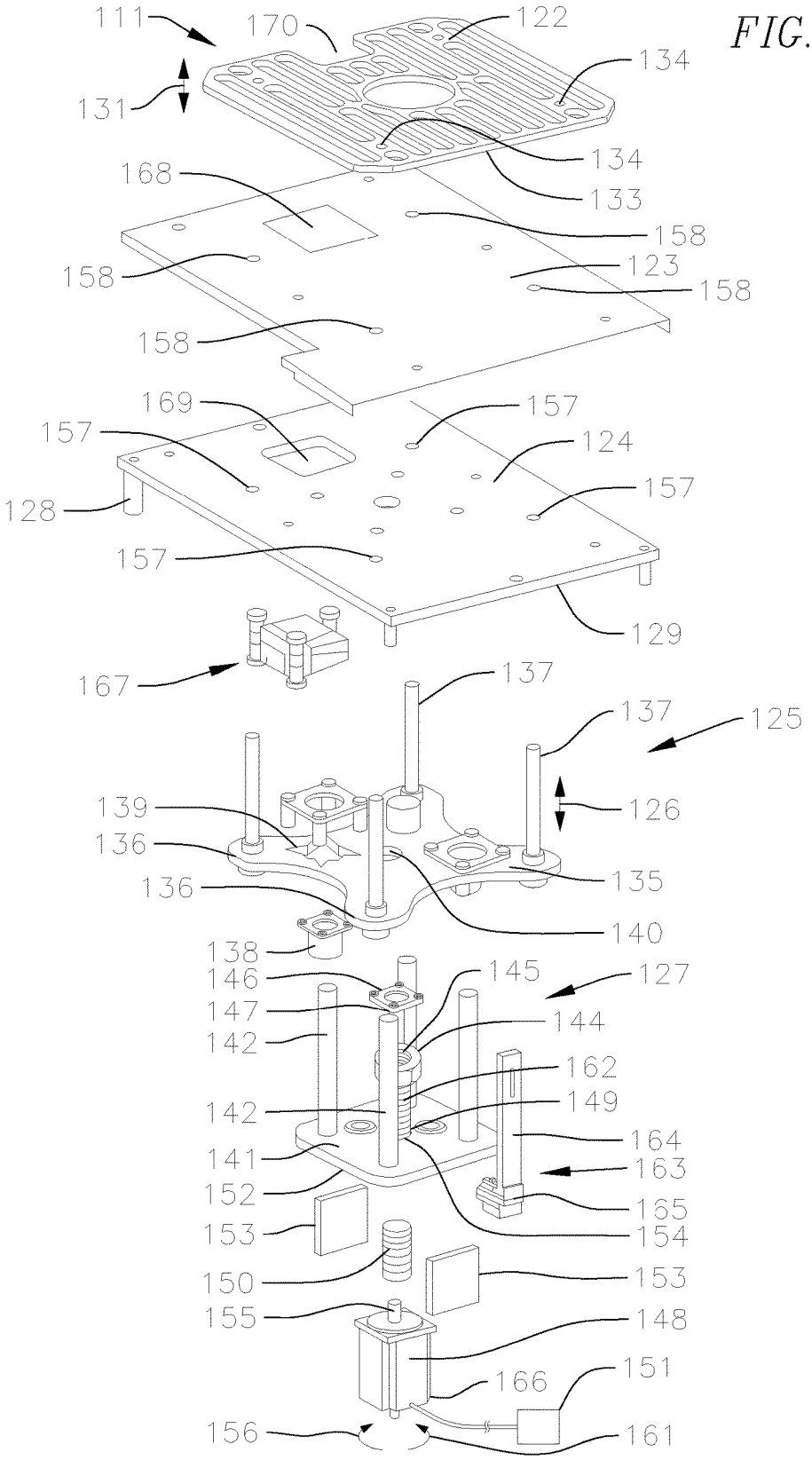

With reference now to the embodiment illustrated in FIGS. 2A and 2B, the ejector assembly 111 includes an ejector plate 122, a guard or cover 123, an upper mounting plate 124, a lifting assembly 125 configured to slide up and down (arrow 126) relative to the upper mounting plate 124, and an actuator assembly 127 coupled to the lifting assembly 125. In the illustrated embodiment, the upper mounting plate 124 is a flat or substantially flat plate. The ejector assembly 111 also includes a series of spacers 128 extending downward from a lower surface 129 of the upper mounting plate 124. The spacers 128 are configured to receive a series of fasteners coupling the upper mounting plate 124 to the loading and unloading platform 102. Additionally, the cover 123, the lifting assembly 125, and the actuator assembly 127 are coupled to the upper mounting plate 124. Accordingly, the spacers 128 on the upper mounting plate 124 enable the ejector assembly 111 to be installed as a modular unit. For instance, the embodiment of the ejector assembly 111 illustrated in FIGS. 2A and 2B may be used to retrofit existing heat sealing systems. Additionally, as illustrated in FIG. 1A, the upper mounting plate 124, the lifting assembly 125, and the actuator assembly 127 of the ejector assembly 111 are received in an opening 130 in the loading and unloading platform 102 outside of the heat press 101. The cover 123 is configured to conceal the upper mounting plate 124 and to prevent an operator from inserting his hand down into the opening 130 in the loading and unloading platform 102, which might otherwise present a pinch hazard when the shuttle 109 is retracting the seal fixture 103 out of the heat press 101 (i.e., when the shuttle 109 is moving the seal fixture 103 from the heat press 101 to the loading and unloading platform 102).

The ejector plate 122 is housed in the interior chamber 116 of the seal fixture 103. As described in more detail below, the ejector plate 122 is configured to move (arrow 131) up and down between a retracted position and a deployed position. In the retracted position, the ejector plate 122 is supported on the lower support plate 114 of the seal fixture 103 and is spaced apart (e.g., spaced below) the one or more lower components 105 supported on the upper seal fixture plate 113. When the ejector plate 122 is moved to the deployed position, the ejector plate 122 is raised off of the lower support plate 114 of the seal fixture 103 and the ejector plate 122 contacts the one or more sealed packages 106 supported on the seal fixture 103 to at least partially raise the one or more sealed packages 106 out of the one or more openings 117 in the seal fixture 103. Additionally, in the illustrated embodiment, the ejector plate 122 defines a series of slots 132 (i.e., the ejector plate 122 is a slotted plate). The slots 132 may be used to couple one or more stiffening members to the ejector plate 122 depending on the intended application of the system, such as, for instance, the weight of the one or more sealed packages 106 and/or the speed at which the ejector plate 122 engages the one or more sealed packages 106. In one or more alternate embodiments, the ejector plate 122 may have any other suitable configuration, such as, for instance, a solid flat plate. The ejector plate 122 may be used with a variety of seal fixtures 103 having different configurations, such as, for instance, with a variety of upper seal fixture plates 113 having different configurations of the one or more openings 117 such that the ejector plate 122 may be used to at least partially raise a variety of sealed packages 106 having different configurations (e.g., sealed packages 106 having different sizes and/or shapes) off of the seal fixture 103. For instance, in one or more embodiments, the ejector plate 122 is a universal ejector plate configured to be used with a wide variety of different seal fixtures 103. Additionally, lower surface 133 of the ejector plate 122 also includes a series of receptacles 134 (e.g., cups), the significance of which is described below.

With continued reference to the embodiment illustrated in FIGS. 2A and 2B, the lifting assembly 125 includes a lift plate 135. In the illustrated embodiment, the lift plate 135 is scalloped and includes a series of lobes 136 arranged peripherally around the lift plate 135. In one or more embodiments, the lift plate 135 may have any other suitable configuration, such as, for instance, a square plate or a circular plate. Accordingly, in one or more embodiments, the lift plate 135 may be provided without the lobes 136. Additionally, in the illustrated embodiment, the lifting assembly 125 includes a series of lift rods 137 located at the lobes 136 and protruding upward from the lift plate 135. The lifting assembly 125 also includes a series of bearing assemblies 138 (e.g., pillow block bearings) received in a series of openings 139 defined in the lift plate 135. Although in the illustrated embodiment the lifting assembly 125 includes four lobes 136 and four corresponding lift rods 137, in one or more alternate embodiments, the lift plate 135 may include any other suitable number of lobes 136 and the lifting assembly 125 may include any other suitable number of lift rods 137, such as, for instance, from two to eight lift rods 137. As described in more detail below, the lift rods 137 of the lifting assembly 125 are configured to engage the receptacles 134 of the ejector plate 122 to move (arrow 131) the ejector plate 122 between the retracted and deployed positions. Additionally, in the illustrated embodiment, the lift plate 135 defines a central opening 140.

Still referring to the embodiment illustrated in FIGS. 2A and 2B, the actuator assembly 127 includes a lower mounting plate 141, a series of linear bearing guides 142 extending up from the lower mounting plate 141, a leadscrew 143 extending up from the lower mounting plate 141, a nut 144 having internal threads 145 coupled to the leadscrew 143, a flange bearing 146 rotatably coupled to an upper end 147 of the leadscrew 143, a motor 148 (e.g., a stepper motor) coupled to a lower end 149 of the leadscrew 143 by a helical coupling 150, and a controller 151 coupled to the motor 148. Although in the illustrated embodiment the actuator assembly 127 includes four linear bearing guides 142, in one or more embodiments, the actuator assembly 127 may include any other suitable number of linear bearing guides 142, such as, for instance, from one to eight linear bearing guides 142. Additionally, in the illustrated embodiment, the motor 148 is coupled to a lower surface 152 of the lower mounting plate 141 by a pair of runners 153 (e.g., flat plates). In the illustrated embodiment, the lower mounting plate 141 also defines a central opening 154. The helical coupling 150 is coupled to the lower end 149 of the leadscrew 143 through the central opening 154 in the lower mounting plate 141.

In the illustrated embodiment, the nut 144 of the actuator assembly 127 is coupled to the lift plate 135 at the central opening 140 in the lift plate 135. The leadscrew 143 of the actuator assembly 127 extends up through the central opening 140 in the lift plate 135 (i.e., the leadscrew 143 extends from the lower mounting plate 141, up through the central opening 140 in the lift plate 135, and up to the flange bearing 146 coupled to the upper mounting plate 124. Accordingly, in the illustrated embodiment, the leadscrew 143 is axially aligned with the central opening 140 defined in the lift plate 135. Additionally, the upper end 147 of the leadscrew 143 is rotatably received in the flange bearing 146. Accordingly, the leadscrew 143 is configured to freely rotate.

The linear bearing guides 142 of the actuator assembly 127 extend up through the bearing assemblies 138 of the lifting assembly 125 and the corresponding openings 139 defined in the lift plate 135 (i.e., the linear bearing guides 142 are axially aligned with the bearing assemblies 138 and the corresponding openings 139 defined in the lift plate 135). The linear bearing guides 142 are configured to support and guide the lifting assembly 125 as it moves up and down (arrow 126) relative to the actuator assembly 127.

When the shuttle 109 inserts the seal fixture 103 into the heat press 101, the receptacles 134 of the ejector plate 122 are not aligned with the lift rods 137 of the lifting assembly 125. When the shuttle 109 removes the seal fixture 103 from the heat press 101 and returns the seal fixture 103 to the loading and unloading platform 102 outside of the heat press 101, the receptacles 134 of the ejector plate 122 are aligned with the lift rods 137. Accordingly, once the shuttle 109 has returned the seal fixture 103 and the one or more sealed packages 106 supported on the seal fixture 103 to the loading and unloading platform 102 following a heat sealing operation in the heat press 101, the motor 148 of the actuator assembly 127 may be activated by the controller 151 to move (arrow 131) the ejector plate 122 into the deployed position to at least partially raise (arrow 112) the one or more sealed packages 106 out of the seal fixture 103, as described in more detail below.

When the motor 148 is activated by the controller 151 to rotate in a first direction, an output shaft 155 of the motor 148 rotates the leadscrew 143 in the first direction (arrow 156). The rotation of the leadscrew 143 causes the nut 144 and the lifting assembly 125 coupled to the nut 144 to slide linearly upward (arrow 126) along the leadscrew 143 and the linear bearing guides 142. Additionally, as the lifting assembly 125 slides upward (arrow 126) along the linear bearing guides 142 of the actuator assembly 127, the lift rods 137 of the actuator assembly 127 extend up through aligned openings 157, 158, 159, 160 in the upper mounting plate 124, the cover 123, the shuttle 109, and the lower support plate 114 of the seal fixture 103, respectively, (see also FIG. 1A) and engage the receptacles 134 on the ejector plate 122. The engagement between the lift rods 137 and the receptacles 134 of the ejector plate 122 causes the ejector plate 122 to move upward (arrow 131) toward the one or more sealed packages 106 supported on the seal fixture 103. When the ejector plate 122 engages the lower ends of the one or more sealed packages 106 supported on the seal fixture 103, the ejector plate 122 raises (arrow 112) the one or more sealed packages 106 at least partially out of the one or more openings 117 in the seal fixture 103 (i.e., the engagement between the ejector plate 122 and the sealed packages 106 forces at least a portion of the sealed packages 106 to protrude above the upper surface 118 of the seal fixture 103). Raising the sealed packages 106 at least partially out of the one or more openings 117 in the seal fixture 103 is configured to enable an operator to safely remove the sealed packages 106 from the seal fixture 103. For instance, the operator may manually remove the seal packages 106 from the seal fixture 103 by grasping the portions of the sealed packages 106 that protrude above the upper surface 118 of the seal fixture 103 and then withdraw the remainder of the one or more sealed packages 106 out of the one or more openings 117 to remove the one or more sealed packages 106 from the seal fixture 103. Raising at least a portion of each of the one or more sealed packages 106 out of the one or more openings 117 in the seal fixture 103 is also configured to mitigate the risk an operator will damage the one or more sealed packages 106 when manually grasping the sealed packages 106 to remove the sealed packages 106 from the one or more openings 117. For instance, raising at least a portion of the one or more sealed packages 106 above the upper surface 118 of the seal fixture 103 may enable the operator to grasp a portion of the one or more sealed packages 106 other than along the sealed joint between the upper and lower components 104, 105 of the sealed package 106. Additionally, raising the one or more sealed packages 106 at least partially out of the one or more openings 117 in the seal fixture 103 is configured to signal to the operator that the seal between the upper and lower components 104, 105 of each sealed package 106 has sufficiently cooled such that the one or more sealed packages 106 may be safely removed from the seal fixture 103 without a significant risk of damaging the sealed packages 106. Additionally, in one or more embodiments, the ejector plate 122 is configured to apply a uniform or generally uniform pressure to partially raise the one or more sealed packages 106 off of the seal fixture 103, which mitigates the risk that the sealed packages 106 will become damaged during removal of the one or more sealed packages 106 from the seal fixture 103.

Following the removal of the one or more sealed packages 106 from the seal fixture 103, the motor 148 of the actuator assembly 127 may be activated by the controller 151 to return the ejector plate 122 to the retracted position. In the illustrated embodiment, when the motor 148 is activated by the controller 151 to rotate in a second direction (arrow 161) opposite the first direction (arrow 156), the output shaft 155 of the motor 148 rotates the leadscrew 143 in the second direction (arrow 161). The rotation of the leadscrew 143 causes the nut 144 and the lifting assembly 125 coupled to the nut 144 to slide linearly downward (arrow 126) along the leadscrew 143 and the linear bearing guides 142. As the lifting assembly 125 slides downward (arrow 126) along the linear bearing guides 142 of the actuator assembly 127, the ejector plate 122 is retracted down away from the openings 117 in the seal fixture 103 and returned to the retracted position in which the ejector plate 122 is supported on the lower support plate 114 of the seal fixture 103. Additionally, as the lifting assembly 125 slides downward along the linear bearing guides 142 of the actuator assembly 127, the lift rods 137 of the actuator assembly 127 are retracted down through the aligned openings 157, 158, 159, 160 in the upper mounting plate 124, the cover 123, the shuttle 109, and the lower support plate 114 of the seal fixture 103, respectively. The above-described tasks of activating the motor 148 to move the ejector plate 122 between the retracted and deployed positions may be repeated for subsequent heat sealing operations of components supported on the seal fixture 103.

External threads 162 on the leadscrew 143 may have any suitable pitch depending on the desired response of the lifting assembly 125 and the ejector plate 122. That is, the pitch of the external threads 162 of the leadscrew 143 may be selected based on the desired mechanical advantage of the ejector assembly 111 (i.e., the ratio of the output of the lifting assembly 125 and the ejector plate 122 to the input of the motor 148). For instance, in one or more embodiments, five complete rotations of the leadscrew 143 cause the lifting assembly 125 to slide upward or downward approximately one inch along the linear bearing guides 142. In one or more embodiments, the external threads 162 on the leadscrew 143 may have a finer pitch or a coarser pitch depending on the desired mechanical response of the lifting assembly 125 and the ejector plate 122. Additionally, in one or more alternate embodiments, the actuator assembly 127 may include any other suitable mechanism for lifting the lifting assembly 125, such as, for instance, a ball screw mechanism or a piston mechanism (e.g., a hydraulic or pneumatic piston).

Additionally, in one or more embodiments, the controller 151 coupled to the motor 148 may be configured (e.g., programmed) to delay raising the one or more sealed packages 106 out of the one or more openings 117 in the seal fixture 103 for a predetermined period of time sufficient to allow the seal joint between the upper and lower components 104, 105 of each sealed package 106 to cool and cure. The delay may be selected depending on the anticipated cooling time of the seal joint between the upper and lower components 104, 105 of each sealed package 106, which may be a function, for instance, of the materials of the upper and lower components 104, 105 (e.g., BoPET, thermoplastic, paper, and/or foil) and/or the composition of an adhesive used to seal the upper and lower components 104, 105 together. The delay may be achieved by selecting the speed at which the ejector plate 122 moves up to the lower end of the one or more sealed packages 106 and/or by including a pause once the ejector plate 122 contacts the lower end of the one or more sealed packages 106. Additionally, in one or more embodiments, the controller 151 may be configured to raise the one or more sealed packages 106 partially out of the one or more openings 117 in the seal fixture 103 by a first distance and then pause for a predetermined duration before further raising the one or more sealed packages 106 out of the one or more openings 117 in the seal fixture 103.

Additionally, in one or more embodiments, the controller 151 coupled to the motor 148 is configured to drive the motor 148 at at least two different speeds (i.e., the motor 148 is a variable speed motor). For instance, in one or more embodiments, the controller 151 may be configured (e.g., programmed) to drive the motor 148 at a faster speed until the ejector plate 122 engages (i.e., contacts) the one or more sealed packages 106 supported on the seal fixture 103 and at a slower speed while the ejector plate 122 is engaged with the one or more sealed packages 106 supported on the seal fixture 103 (i.e., the controller 151 may be configured to drive the motor 148 and the ejector plate 122 at a first speed toward the one or more sealed packages 106 when the ejector plate 122 is spaced apart from the one or more sealed packages 106 and at a second speed less than the first speed when the ejector plate 122 is contacting the one or more sealed packages 106 to raise the one or more sealed packages 106 out of the one or more openings 117 in the seal fixture 103). In one or more embodiments, the faster speed of the motor 148 may drive the ejector plate 122 at a rate from approximately 2 inches per second (in/sec) to approximately 6 in/sec, such as, for instance, approximately 4 in/sec. In one or more embodiments, the slower speed of the motor 148 may drive the ejector plate 122 at a rate from approximately ¼ in/sec to approximately 1 in/sec, such as, for instance, approximately ½ in/sec. In one or more embodiments, the faster and slower speeds of the motor 148 may drive the ejector plate 122 at any other rates suitable for the intended application of the system.

Additionally, in the embodiment illustrated in FIGS. 2A and 2B, the ejector assembly 111 includes a sensor assembly 163. In the illustrated embodiment, the sensor assembly 163 includes a sensor mounting bracket 164 coupled to the upper mounting plate 124 and a sensor 165 (e.g., an infrared proximity sensor) coupled to the sensor mounting bracket 164. The sensor 165 is configured to measure a position of the lift plate 135 of the lifting assembly 125 relative to the lower mounting plate 141 of the actuator assembly 127. For instance, the sensor 165 may measure an end-of-travel of the lifting assembly 125. Accordingly, the sensor 165 may be used to set the position of the ejector plate 122 relative to the one or more sealed packages 106 supported on the seal fixture 103. The sensor 165 may also be used to ensure that the one or more sealed packages 106 are lifted out of the one or more openings 117 in the seal fixture 103 at the desired time (e.g., with the desired delay between removal of the one or more sealed packages 106 from the heat press 101 and the lifting of the one or more sealed packages 106 out of the one or more openings 117 in the seal fixture 103). The sensor 165 may also be used to ensure that the one or more sealed packages 106 are raised out of the one or more openings 117 in the seal fixture 103 by the desired height.

Additionally, in the illustrated embodiment, the actuator assembly 127 includes a rotary encoder 166 coupled to the motor 148. The rotary encoder 166 is configured to monitor one or more operating conditions of the motor 148, such as, for instance, a speed of the motor 148 (e.g., revolutions per minute (RPM) and send an electrical signal to the controller 151. Based upon the signal received from the rotary encoder 166, the controller 151 may adjust the input to the motor 148 to maintain the desired output of the motor 148. Accordingly, the rotary encoder 166 is configured to control the precision of the motor 148 and thus the precision of the vertical position of the ejector plate 122. The rotary encoder 166 may be any type of encoder suitable for the type of motor 148, such as, for instance, a magnetic, optical, or mechanical encoder.

In the embodiment illustrated in FIGS. 2A and 2B, the ejector assembly 111 also includes a radio frequency identification (RFID) sensor 167. In the illustrated embodiment, the RFID sensor 167 is coupled to the lower surface 129 of the upper mounting plate 124. Additionally, in the illustrated embodiment, the cover 123 and the upper mounting plate 124 each define an opening 168, 169 (e.g., a window), respectively, aligned with the RFID sensor 167 and the ejector plate 122 defines a notch 170 aligned with the RFID sensor 167. The RFID sensor 167 is configured to read a readable code stored on a tag on one or more of the components 104, 105 to be sealed together. The RFID sensor 167 and corresponding tag on the components 104, 105 may be used, for instance, to confirm whether the heat press 101 is properly configured to accommodate the type of components 104, 105 loaded on the seal fixture 103. If the type of components detected by the RFID sensor 167 is incompatible with the setup of the heat press 101, the system may prevent the shuttle 109 from entering the sealing chamber 107 of the heat press 101 and/or may signal to an operator that the heat press 101 is not properly configured for the type of components 104, 105 loaded on the seal fixture 103. In one or more alternate embodiments, the ejector assembly 111 may be provided without the RFID sensor 167, the openings 168, 169 in the cover 123 and the upper mounting plate 124, respectively, and the notch 170 in the ejector plate 122.

While this invention has been described in detail with particular references to embodiments thereof, the embodiments described herein are not intended to be exhaustive or to limit the scope of the invention to the exact forms disclosed. Persons skilled in the art and technology to which this invention pertains will appreciate that alterations and changes in the described structures and methods of assembly and operation can be practiced without meaningfully departing from the principles, spirit, and scope of this invention. One or more of the described features may be combined with one or more other described features to provide a workable device. Additionally, although relative terms such as "horizontal," "vertical," "upper," "lower," and similar terms have been used herein to describe a spatial relationship of one element to another, it is understood that these terms are intended to encompass different orientations of the various elements and components of the invention in addition to the orientation depicted in the figures. Additionally, as used herein, the term "substantially" and similar terms are used as terms of approximation and not as terms of degree, and are intended to account for the inherent deviations in measured or calculated values that would be recognized by those of ordinary skill in the art. Furthermore, as used herein, when a component is referred to as being "on" or "coupled to" another component, it can be directly on or attached to the other component or intervening components may be present therebetween.

What is claimed is:

1. A system for heat sealing two or more components together into at least one sealed package, the system comprising:

a heat press configured to heat seal the two or more components together into the at least one sealed package;

a seal fixture comprising an upper seal fixture plate configured to support the two or more components;

an ejector plate under the upper seal fixture plate, the ejector plate configured to move between a retracted position and a deployed position to at least partially raise the at least one sealed package off of the upper seal fixture plate;

a controller configured to move the ejector plate at a first speed toward the at least one sealed package supported on the seal fixture when the ejector plate is spaced apart from the at least one sealed package and to move the ejector plate at a second speed less than the first speed when the ejector plate is engaged with the at least one sealed package supported on the seal fixture.

2. The system according to claim 1, further comprising a shuttle supporting the seal fixture, wherein the shuttle is configured to transport the seal fixture between a loading and unloading platform outside the heat press and an operating position inside the heat press.

3. The system according to claim 2, further comprising a lifting assembly under the loading and unloading platform, the lifting assembly configured to engage the ejector plate to move the ejector plate between the retracted position and the deployed position.

4. The system according to claim 2, further comprising a shuttle motor coupled to the shuttle, the shuttle motor configured to move the shuttle and the seal fixture between the loading position outside the heat press and the operating position inside the heat press.

5. The system according to claim 2, wherein the shuttle is configured to be moved manually between the loading position outside the heat press and the operating position inside the heat press.

6. The system according to claim 1, wherein the upper seal fixture plate defines at least one opening configured to accommodate at least a portion of one component of the two or more components.

7. The system according to claim 6, wherein the seal fixture further comprises a plurality of locating pins arranged around the at least one opening.

8. The system according to claim 1, wherein the ejector plate comprises a slotted plate.

9. A system for heat sealing two or more components together into at least one sealed package, the system comprising:

a seal fixture configured to support the two or more components to be heat sealed together by a heat press;

an ejector plate configured to move between a retracted position and a deployed position to at least partially raise the at least one sealed package off of the seal fixture; and a lifting assembly comprising a plurality of lift rods configured to engage a plurality of receptacles on the elector plate to move the ejector plate between the retracted position and the deployed position.

10. The system according to claim 9, wherein:

when the at least one sealed package is supported on the seal fixture and the ejector plate is in the retracted position, the ejector plate is spaced apart from the at least one sealed package; and when the at least one sealed package is supported on the seal fixture and the ejector plate is in the deployed position, the ejector plate is engaged with the at least one sealed package.

11. The system according to claim 9, further comprising a shuttle supporting the seal fixture, wherein the shuttle is configured to transport the seal fixture between a loading and unloading platform outside the heat press and an operating position inside the heat press.

12. The system according to claim 11, wherein the lifting assembly is under the loading and unloading platform.

13. The system according to claim 11, further comprising a shuttle motor coupled to the shuttle, the shuttle motor configured to move the shuttle and the seal fixture between the loading position outside the heat press and the operating position inside the heat press.

14. The system according to claim 11, wherein the shuttle is configured to be moved manually between the loading position outside the heat press and the operating position inside the heat press.

15. The system according to claim 9, wherein the seal fixture defines at least one opening configured to accommodate at least a portion of one component of the two or more components.

16. The system according to claim 15, wherein the seal fixture further comprises a plurality of locating pins arranged around the at least one opening.

17. The system according to claim 15, wherein the seal fixture further comprises a gasket arranged around the at least one opening.

18. The system according to claim 9, wherein the ejector plate comprises a slotted plate.

19. The system according to claim 9, further comprising a controller configured to move the ejector plate at a first speed toward the at least one sealed package supported on the seal fixture when the ejector plate is spaced apart from the at least one sealed package and to move the ejector plate at a second speed less than the first speed when the ejector plate is engaged with the at least one sealed package supported on the seal fixture.

20. A system for heat sealing two or more components together into at least one sealed package, the system comprising:

a heat press configured to heat seal the two or more components together into the least one sealed package;

a seal fixture comprising an upper seal fixture plate configured to support the two or more components;

an ejector plate under the upper seal fixture plate, the ejector plate comprising at least one receptacle, wherein the ejector plate is configured to move between a retracted position and a deployed position to at least partially raise the at least one sealed package off of the upper seal fixture plate;

a lifting assembly comprising at least one lift rod configured to selectively engage and disengage the at least one receptacle of the ejector plate to move the ejector plate between the retracted position and the deployed position; and an actuator assembly configured to engage the lifting assembly to cause the at least one lift rod to selectively engage and disengage the at least one receptacle of the ejector plate, the actuator assembly comprising a motor and a controller configured to actuate the motor.

21. A system for heat sealing two or more components together into at least one sealed package, the system comprising:

a seal fixture configured to support the two or more components to be heat sealed together by a heat press;

an ejector plate configured to move between a retracted position and a deployed position to at least partially raise the at least one sealed package off of the seal fixture; and a controller configured to move the ejector plate at a first speed toward the at least one sealed package supported on the seal fixture when the ejector plate is spaced apart from the at least one sealed package and to move the ejector plate at a second speed less than the first speed when the ejector plate is engaged with the at least one sealed package supported on the seal fixture.

* * * * *